US010661574B2

(12) United States Patent
Watanabe et al.

(10) Patent No.: US 10,661,574 B2
(45) Date of Patent: May 26, 2020

(54) LIQUID EJECTING APPARATUSES

(71) Applicant: SEIKO EPSON CORPORATION, Tokyo (JP)

(72) Inventors: Eiichiro Watanabe, Matsumoto (JP); Masaru Kumagai, Shiojiri (JP); Yukihiro Hanaoka, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/352,648

(22) Filed: Mar. 13, 2019

(65) Prior Publication Data

US 2019/0283441 A1 Sep. 19, 2019

(30) Foreign Application Priority Data

Mar. 15, 2018 (JP) ..... 2018-047624

(51) Int. Cl.
*B41J 2/175* (2006.01)
*B41J 2/17* (2006.01)
*B41J 2/165* (2006.01)

(52) U.S. Cl.
CPC ..... *B41J 2/17566* (2013.01); *B41J 2/16523* (2013.01); *B41J 2/1707* (2013.01); *B41J 2/17596* (2013.01); *B41J 2002/16597* (2013.01)

(58) Field of Classification Search
CPC .. B41J 2/17566; B41J 2/1707; B41J 2/16523; B41J 2/17596; B41J 2002/16597; B41J 2/175; B41J 2/16517; B41J 2/1652; B41J 2/16532; B41J 2/17
See application file for complete search history.

(56) References Cited

U.S. PATENT DOCUMENTS

2011/0148955 A1* 6/2011 Tsuchiya ..... B41J 2/175 347/1
2012/0139979 A1 6/2012 Tokuno
2012/0206547 A1 8/2012 Shirotori
2013/0147867 A1* 6/2013 Kobayashi ..... B41J 2/17566 347/7
2013/0222460 A1 8/2013 Sawase

FOREIGN PATENT DOCUMENTS

JP 2012-121145 A 6/2012
JP 2012-166473 A 9/2012
JP 2012-240284 A 12/2012
JP 2013-173274 A 9/2013

* cited by examiner

*Primary Examiner* — Julian D Huffman
(74) *Attorney, Agent, or Firm* — Workman Nydegger

(57) ABSTRACT

A liquid ejecting apparatus includes a liquid ejecting head that ejects liquid through a nozzle, a supply flow path that supplies liquid from a liquid container containing liquid to the liquid ejecting head, a liquid chamber provided in a buffer chamber disposed in the supply flow path, the liquid chamber being configured to change in volume, a liquid feeding unit of a reversible type disposed in the supply flow path between the liquid container and the liquid chamber, a control portion that controls driving of the liquid feeding unit, and a suction unit that suctions liquid through the nozzle. The control portion controls the liquid feeding unit to perform reverse feeding of the liquid from the liquid chamber to the liquid container before the suction unit suctions the liquid through the nozzle.

13 Claims, 4 Drawing Sheets

LIQUID EJECTING APPARATUSES

BACKGROUND

1. Technical Field

The present invention relates to liquid ejecting apparatuses.

2. Related Art

Ink jet printers (hereinafter, also referred to as "printers") are widely known as a liquid ejecting apparatus that ejects liquid onto a target such as a paper sheet.

Conventionally, some of these printers include a liquid feeding unit which uses a pulsation pump such as a diaphragm pump for supplying ink to a liquid ejecting head which is configured to eject ink (liquid). Such a pulsation pump performs a suctioning operation by which ink is suctioned from a liquid container such as an ink cartridge, and an ejection operation by which ink suctioned by the suctioning operation is ejected toward the liquid ejecting head in an alternate manner. Accordingly, ink supply temporarily stops during the suctioning operation. In view of this, the conventional printers include a buffer chamber that temporarily stores ink ejected from the pump, so that ink is supplied to the liquid ejecting head during the suctioning operation. JP-A-2012-166473 is an example of related art.

Further, some of the conventional printers include a choke valve disposed between the buffer chamber and the liquid ejecting head. The choke valve is configured to be closed to thereby close the liquid supplying path when a negative pressure on the downstream side which is closer to the liquid ejecting head becomes larger than a pressure applied to the buffer chamber. When cleaning (suction cleaning) for discharging ink in the liquid ejecting head is performed by driving the suction pump while the cap is in contact with the liquid ejecting head to thereby generate a negative pressure, the choke valve is closed due to increase in the negative pressure and thus the liquid supplying path is closed. As the suction cleaning is continued, the negative pressure in the liquid ejecting head increases. Subsequently, when the pump performs ejection operation, a pressure on the upstream side of the choke valve increases to cause the choke valve to open, and choke cleaning is performed by which air bubbles and thickened ink accumulated in the liquid ejecting head are discharged through the nozzles together with ink ejected by the pump.

However, in the conventional liquid ejecting apparatus as described above, the buffer chamber and the choke valve need to be separately provided.

Further, in the liquid ejecting apparatus that uses a pump which is available only for supply of liquid, the supply flow path is closed during choke cleaning by stopping the pump and performing suctioning while a pressure is applied to the buffer chamber and sufficient liquid is present in the liquid chamber for choke cleaning. In such a liquid ejecting apparatus, when choke cleaning is performed in a head having a large number of nozzles such as a line head, there is a risk that liquid in the buffer chamber and in the liquid chamber for choke cleaning are discharged and wasted until the supply flow path is closed.

SUMMARY

An advantage of some aspects of the invention can be implemented in the embodiments described below.

According to an aspect of the invention, a liquid ejecting apparatus includes: a liquid ejecting head that ejects liquid through a nozzle; a supply flow path that supplies the liquid from a liquid container containing the liquid to the liquid ejecting head; a liquid chamber provided in a buffer chamber disposed in the supply flow path, the liquid chamber being configured to change in volume; a liquid feeding unit of a reversible type disposed in the supply flow path between the liquid container and the liquid chamber; a control portion that controls driving of the liquid feeding unit to perform forward feeding of the liquid from the liquid container to the liquid chamber and reverse feeding of the liquid from the liquid chamber to the liquid container; and a suction unit that suctions liquid through the nozzle, wherein the buffer chamber causes a flow rate of the liquid flowing in the supply flow path to decrease with a decrease of the liquid in the liquid chamber, and the control portion controls the liquid feeding unit to perform reverse feeding of the liquid from the liquid chamber to the liquid container before the suction unit suctions the liquid through the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a liquid ejecting apparatus will now be described. The liquid ejecting apparatus is an ink jet printer that performs recording (printing) by ejecting ink which is an example of liquid onto a medium such as a paper sheet.

Figure 1:
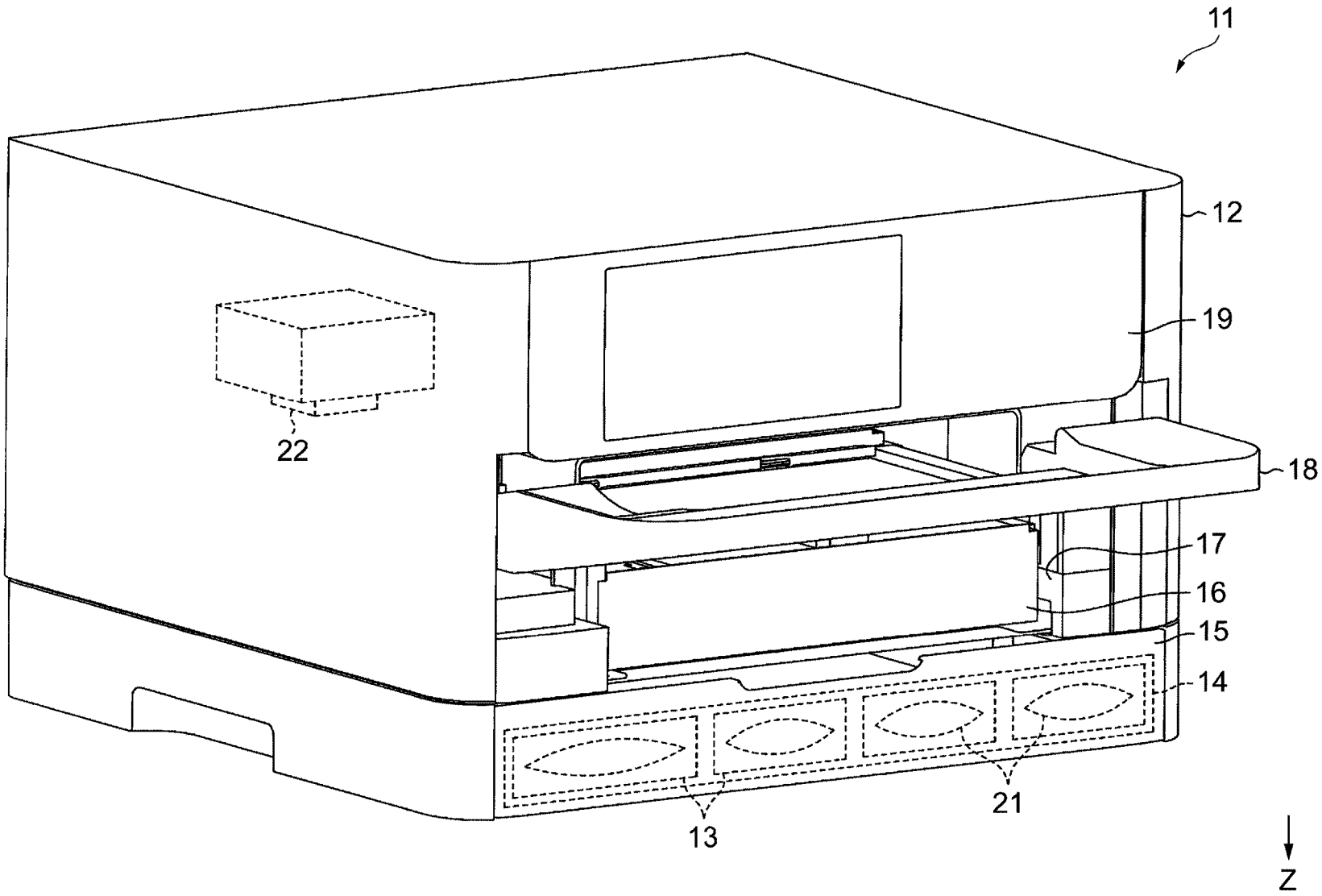
FIG. 1 is a perspective view of a printer (liquid ejecting apparatus), which is an example of an application of the invention.

As shown in FIG. 1, a liquid ejecting apparatus 11 includes a housing 12 having a substantially cuboid shape. In the figure, the liquid ejecting apparatus 11 is shown as being positioned on a horizontal surface, and the gravity direction is indicated by a Z axis, which is a vertical direction Z. A side surface of the housing 12 on which operation to the liquid ejecting apparatus 11 is mainly performed is referred to as a front surface.

A front cover 15 and an attachment port 17 are disposed in this order from the bottom on the front surface of the housing 12. The front cover 15 rotatably covers an attachment section 14 in which a container 13 is detachably attached, and the attachment port 17 is provided such that a medium accommodating portion 16 for accommodating media (not shown) such as paper sheets is mounted therein. A discharge tray 18 through which a medium is discharged, and an operation panel 19 which is used to operate the liquid ejecting apparatus 11 are disposed on the upper side of the attachment port 17.

One or more (in the present embodiment, four) containers 13 can be mounted in the attachment section 14. In each container 13, a liquid supply source such as a liquid storing member that stores liquid (hereinafter, also referred to as a liquid container) 21 is detachably mounted. The respective liquid supply sources 21 store different types of liquid (for example, ink of different colors such as black, cyan, magenta, and yellow), and serve as liquid supply sources for a liquid ejecting head 22.

Figure 2:
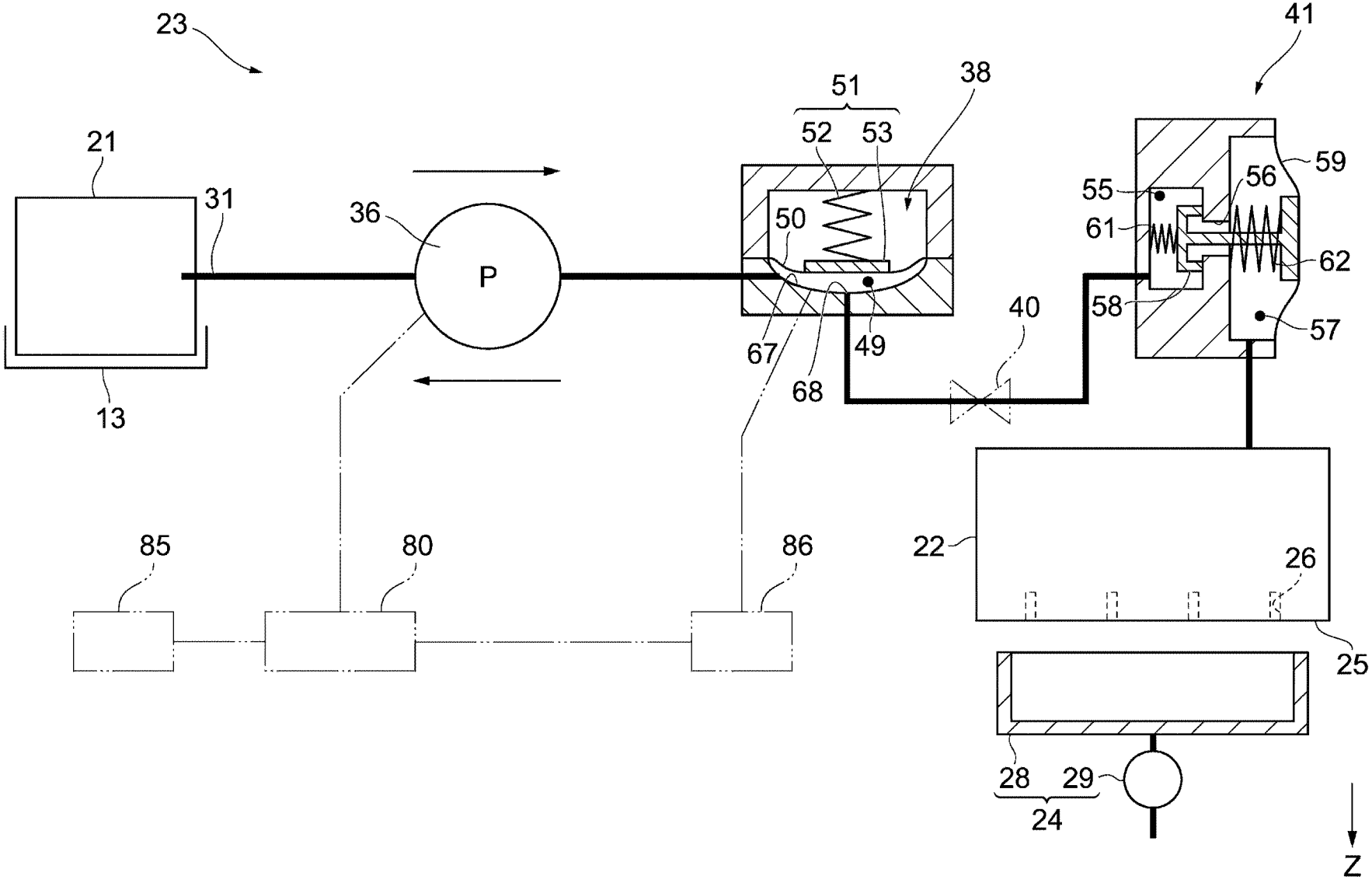
FIG. 2 is a schematic diagram of a supply portion that supplies liquid to a liquid ejecting head from a liquid supply source.

As shown in FIG. 2, the liquid ejecting apparatus 11 includes the liquid ejecting head 22 that ejects liquid, a supply portion 23 that supplies liquid from the liquid supply source 21 to the liquid ejecting head 22, and a maintenance portion (suction unit) 24 that performs maintenance of the liquid ejecting head 22. A plurality of nozzles 26 for ejecting liquid are formed on a nozzle forming surface 25 of the liquid ejecting head 22. Further, the liquid ejecting apparatus 11 includes a control portion 80 that controls driving of a pump 36.

The maintenance portion 24 includes a cap 28 that receives liquid discharged through the nozzles 26, and a suction mechanism 29 that suctions inside the cap 28. The cap 28 abuts the liquid ejecting head 22 to define a closed space between the cap 28 and the nozzle forming surface 25 to which the nozzles 26 are open, and performs capping for the liquid ejecting head 22.

Next, the supply portion 23 will be described. The liquid ejecting apparatus 11 includes one or more (in the present embodiment, four) supply portions 23 corresponding to the types of liquid ejected from the liquid ejecting head 22. For example, when the liquid ejecting apparatus 11 is a printer, the supply portions 23 are provided for each color of ink. The liquid ejecting apparatus 11 of the present embodiment includes the same number of supply portions 23 as the number of liquid supply sources 21 disposed in the containers 13 that can be mounted in the attachment section 14. The respective supply portions 23 have the same configuration. Accordingly, one supply portion 23 will be described, and the same reference numbers are used to avoid the duplicated description.

First Embodiment

As shown in FIG. 2, the supply portion 23 includes a supply flow path 31 for supplying liquid from the liquid supply source 21 to the liquid ejecting head 22. In the following description, an end of the supply flow path 31 which is connected to the liquid supply source 21 is referred to as an upstream side, and an end which is connected to the liquid ejecting head 22 is referred to as a downstream side.

A pump (liquid feeding unit) 36, a buffer chamber 38, and a pressure regulating valve 41 are disposed in this order from the upstream side in the supply flow path 31.

The pump 36 serves as a liquid feeding unit for feeding ink, and is disposed in the supply flow path 31 at a position between the liquid container 21 and the buffer chamber 38. The pump 36 of the present embodiment is a reversible pump that allows for forward feeding of ink toward the downstream side and reverse feeding of ink toward the upstream side.

The buffer chamber 38 is disposed in the supply flow path 31 at a position downstream relative to the pump 36. The buffer chamber 38 includes a storage chamber (liquid chamber) 49 for storing liquid, a flexible member 50 that forms part of wall of the storage chamber 49, and a pressure applying section 51 that applies pressure to the flexible member 50 from outside the storage chamber 49. The storage chamber 49 forms part of the supply flow path 31. The buffer chamber 38 of the present embodiment has an outlet 68 disposed at a position facing the flexible member 50 so that liquid flows out from the storage chamber (liquid chamber) 49 toward the downstream side. As the amount of liquid decreases, the flexible member 50 is displaced in a direction to reduce the volume of the storage chamber (liquid chamber) 49, and abuts the outlet 68 to thereby close the supply flow path 31. That is, the buffer chamber 38 of the present embodiment is configured to reduce the flow rate of liquid flowing in the supply flow path 31 with a decrease in the amount of liquid in the storage chamber (liquid chamber) 49. As described above, the buffer chamber 38 of the present embodiment also serves as a flow rate control valve that forcibly changes the flow rate of liquid flowing in the supply flow path 31.

The pressure applying section 51 includes a first urging portion 52 that biases the flexible member 50 in a direction to reduce the volume of the storage chamber 49, and a pressure receiving member 53 disposed between the first urging portion 52 and the flexible member 50. As the flexible member 50 is displaced, the volume of the storage chamber 49 changes so that the buffer chamber 38 mitigates the variation in pressure of liquid. The pressure applying section 51 applies pressure to the liquid stored in the storage chamber 49 to cause the liquid to be supplied from the storage chamber 49.

The first urging portion 52 biases the flexible member 50 in a direction to reduce the volume of the storage chamber 49 so that the liquid is pressurized and supplied to the liquid ejecting head 22. The first urging portion 52 of the present embodiment is a compression coil spring, and applies a maximum biasing force when it is most compressed and a minimum biasing force when it is most expanded. In the buffer chamber 38, a pressure applied to the liquid when the first urging portion 52 biases the flexible member 50 with the maximum biasing force is defined as a maximum pressure, and a pressure applied to the liquid when the first urging portion 52 biases the flexible member 50 with the minimum biasing force is defined as a minimum pressure.

The maximum pressure is a pressure when the volume of the storage chamber 49 is maximum, and the minimum pressure is a pressure when the volume of the storage chamber 49 is minimum. The minimum pressure is higher than the pressure required to supply liquid from the buffer chamber 38 to the liquid ejecting head 22.

The pressure regulating valve 41 includes a supply chamber 55 to which liquid is supplied, a pressure chamber 57 that can communicate with the supply chamber 55 via a communication hole 56, and a valve body 58 that can close and open the communication hole 56. Part of the pressure chamber 57 is formed of a flexible wall 59 that can be flexibly deformed. The supply chamber 55, the communication hole 56, and the pressure chamber 57 form part of the supply flow path 31.

The pressure regulating valve 41 includes an upstream urging portion 61 that is housed in the supply chamber 55, and a downstream urging portion 62 that is housed in the pressure chamber 57. The upstream urging portion 61 and the downstream urging portion 62 bias the valve body 58 in a direction to close the communication hole 56. Alternatively, the pressure regulating valve 41 may include one of the upstream urging portion 61 and the downstream urging portion 62.

Next, an operation of the liquid ejecting apparatus 11 will be described. The description will be made on the assumption that the supply flow path 31 and the liquid ejecting head 22 are filled with liquid.

As the liquid ejecting head 22 ejects liquid, the liquid in the pressure chamber 57 of the pressure regulating valve 41 is supplied to the liquid ejecting head 22. When the liquid in the pressure chamber 57 is supplied and the inner pressure of the pressure chamber 57 decreases to cause a force of the flexible wall 59 pressing the valve body 58 to become larger than the biasing forces of the upstream urging portion 61 and the downstream urging portion 62, the valve body 58 opens the communication hole 56. That is, the pressure regulating valve 41 opens when the downstream side reaches a predetermined negative pressure. When the communication hole 56 is opened, the liquid flows from the supply chamber 55 into the pressure chamber 57 and the liquid stored in the storage chamber 49 flows into the supply chamber 55. As the inner pressure of the pressure chamber 57 of the pressure regulating valve 41 increases, the biasing forces of the upstream urging portion 61 and the downstream urging portion 62 cause the valve body 58 to close the communication hole 56.

When the amount of liquid supplied from the pump 36 is larger than the amount of liquid consumed by the liquid ejecting head 22 per unit time, liquid remains stored in the buffer chamber 38. In particular, if a large amount of specific liquid is consumed, for example in monochrome printing, in the liquid ejecting apparatus 11 having a plurality of supply portions 23, liquid needs to be supplied in line with the specific liquid that is more likely to be consumed.

The maintenance portion 24 is configured to perform cleaning, including suction cleaning, choke cleaning, and the like, which is a maintenance operation to discharge foreign substances such as air bubbles by expelling liquid through the nozzles 26.

The suction cleaning is performed by driving the suction mechanism 29 while the liquid ejecting head 22 is capped. The suction cleaning discharges foreign substances such as air bubbles in the liquid ejecting head 22 together with liquid through the nozzles 26.

The choke cleaning is performed by driving the suction mechanism 29 while the liquid ejecting head 22 is capped and the pump 36 is not driven. As the amount of liquid decreases by driving of the suction mechanism 29, the flexible member 50 is displaced in a direction to reduce the volume of the storage chamber (liquid chamber) 49 in the buffer chamber 38 and closes the supply flow path 31. When the suction mechanism 29 is continued to be driven, negative pressure is applied to a region from a location closed by the flexible member 50 to the nozzles 26.

Subsequently, as the pump 36 is actuated, the flexible member 50 is displaced in a direction to increase the volume of the storage chamber (liquid chamber) 49 in the buffer chamber 38 and opens the supply flow path 31. Accordingly, liquid which has been supplied to the buffer chamber 38 is ejected toward the liquid ejecting head 22. Thus, according to the liquid ejecting apparatus 11 having a configuration of the present embodiment, the flexible member 50 of the buffer chamber 38 can also serve as a choke valve.

However, in the configuration of the present embodiment, liquid stored in the storage chamber (liquid chamber) 49 is discharged before the flexible member 50, which is a choke valve, closes the supply flow path 31. In order to address such an issue, according to the present embodiment, the control portion 80 controls the pump 36 to perform reverse feeding of liquid from the storage chamber (liquid chamber) 49 to the liquid container 21 before the maintenance portion (suction unit) 24 suctions liquid through the nozzles 26. With this configuration, choke cleaning can be performed without discharging and wasting liquid stored in the storage chamber (liquid chamber) 49 during choke cleaning.

In performing choke cleaning in the liquid ejecting apparatus 11 of the present embodiment, the control portion 80 controls the pump 36 to perform forward feeding of liquid from the liquid container 21 to the storage chamber 49 after the maintenance portion (suction unit) 24 suctions liquid through the nozzles 26.

Further, in performing choke cleaning in the liquid ejecting apparatus 11 of the present embodiment, the control portion 80 controls the pump 36 to perform reverse feeding of liquid from the storage chamber 49 to the liquid container 21 until the volume of the storage chamber 49 becomes smaller than a predetermined volume (hereinafter, also referred to as a "first volume") before the maintenance portion 24 suctions liquid through the nozzles 26. Accordingly, by performing choke cleaning after the amount of liquid stored in the storage chamber 49 becomes smaller than the predetermined volume (first volume), liquid in the storage chamber 49 of the buffer chamber 38 can be prevented from being discharged and wasted. Further, since the pressure regulating valve 41 is provided in the supply flow path 31 at a position downstream relative to the storage chamber 49, the liquid ejecting head 22 can be prevented from being effected by pressure change on the upstream side due to liquid migration.

Moreover, in performing choke cleaning in the liquid ejecting apparatus 11 of the present embodiment, the control portion 80 controls the pump 36 to perform forward feeding of liquid from the liquid container 21 to the storage chamber 49 until the volume of the storage chamber 49 becomes larger than a predetermined volume (hereinafter, also referred to as a "second volume") after the maintenance portion (suction unit) 24 suctions liquid through the nozzles 26. Accordingly, by appropriately setting the second volume which is a target volume, liquid of a sufficient amount, which is larger than the second volume, can be supplied to the storage chamber 49.

In addition, in the configuration of the present embodiment, if the amount of liquid stored in the liquid container 21 is small, there is a possibility that the amount of liquid required for choke cleaning cannot be supplied in supply of liquid to the storage chamber (liquid chamber) 49 by driving the pump 36 after suctioning of choke cleaning is performed. As a result, there is a risk that outside air is entrained into the supply flow path 31 via the nozzles 26. In order to address such an issue, according the liquid ejecting apparatus 11 of the present embodiment, forward feeding of liquid from the liquid container 21 to the storage chamber 49 is performed until the volume of the storage chamber 49 becomes larger than the second volume before reverse feeding of liquid from the storage chamber 49 to the liquid container 21 is performed in choke cleaning. By confirming whether forward feeding of liquid can be performed from the liquid container 21 to the storage chamber 49 until the volume of the storage chamber 49 becomes larger than the second volume, it is possible to confirm in advance whether the amount of remaining liquid (remaining ink) in the liquid container 21 is sufficient for performing choke cleaning.

Further, in performing choke cleaning in the liquid ejecting apparatus 11 of the present embodiment, notification is made when forward feeding of liquid from the liquid container 21 to the storage chamber 49 fails to cause the volume of the storage chamber 49 to become larger than the second volume. Further, the control portion 80 stops the pump 36. With this configuration, a user can be notified when the amount of remaining liquid (remaining ink) in the liquid container 21 is not sufficient for performing choke cleaning. Further, the operation can be automatically stopped. As a notification unit 85 for notifying such information, various devices such as those for displaying the information on the operation panel 19, flashing light, generating sound, and displaying on the computer screen can be used.

Further, in the liquid ejecting apparatus 11 of the present embodiment, when the volume of the storage chamber 49 does not become larger than the second volume and the control portion 80 stops the pump 36, the control portion 80 then causes the suction mechanism 29 to perform suctioning of a predetermined amount. With this configuration, according to the present embodiment, when the amount of remaining liquid (remaining ink) in the liquid container 21 is not sufficient for performing choke cleaning, the operation can be automatically changed to suction cleaning, which involves a smaller suctioning amount than choke cleaning. Further, when the volume of the storage chamber 49 does not become larger than the second volume and the control portion 80 stops the pump 36, the user is prompted to choose at least one of exchanging the liquid container 21 and performing suction cleaning by the maintenance portion (suction unit) 24 to thereby choose the subsequent operation. With this configuration, a user can choose the subsequent operation when the amount of remaining liquid in the liquid container 21 is not sufficient for performing choke cleaning. As a unit for prompting the user with the above options, the operation panel 19 displaying these options or the like can be used.

In addition, the liquid ejecting apparatus 11 of the present embodiment further includes a detecting section 86 for detecting the volume of the storage chamber 49 (see FIG. 2). The detecting section 86 detects the volume, for example, by directly optically detecting deformation of the flexible member 50 of the buffer chamber 38 or by detecting the position of the deformed part which is displaced in accordance with deformation of the flexible member 50. Alternatively, after forward feeding of liquid from the liquid container 21 to the storage chamber 49 is performed by using the pump 36 until the volume of the storage chamber 49 becomes larger than the second volume, the amount of liquid consumed by the liquid ejecting head 22 is measured to thereby determine the volume of the storage chamber 49. Further, when a buffer chamber 38 having a flow path which allows the storage chamber 49 to be open to the atmosphere is used, the liquid volume in the storage chamber 49 can be detected by optically detecting the liquid level from outside, or by providing a float in the storage chamber 49 and detecting the movement of the float from outside, or by detecting the position of a liquid level by using an electrode disposed in the storage chamber 49.

Second Embodiment

Figure 3:
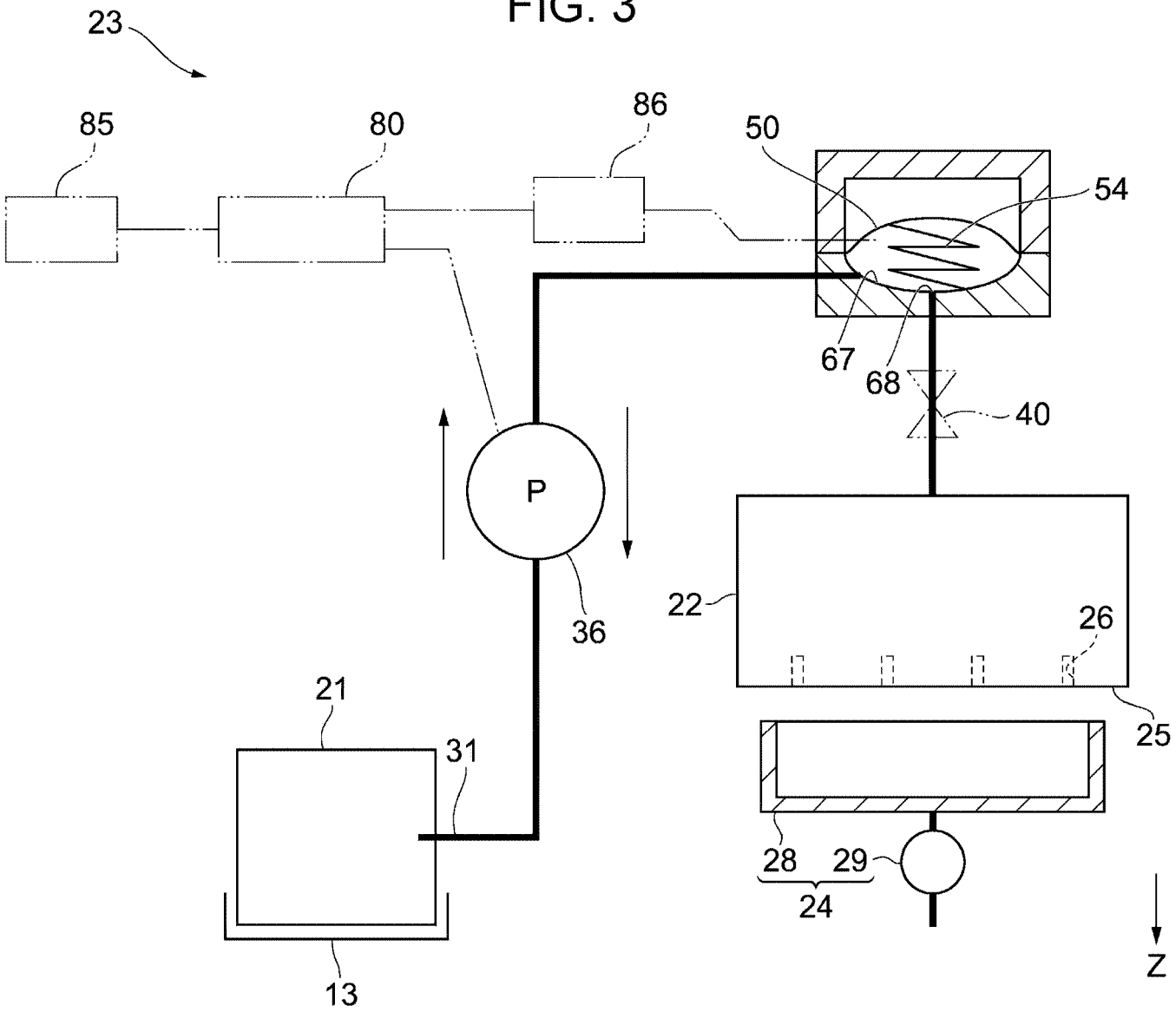
FIG. 3 is a schematic diagram of a supply portion, illustrating another embodiment of the liquid ejecting apparatus.

As shown in FIG. 3, the liquid ejecting apparatus 11 includes a second urging portion 54 instead of the first urging portion 52 of the above embodiment. The second urging portion 54 biases the flexible member 50 in a direction to increase the volume of the storage chamber 49.

In the liquid ejecting apparatus 11, the nozzles 26 of the liquid ejecting head 22 are disposed at positions vertically above the top of the liquid container 21. In this case, the pressure regulating valve 41 of the first embodiment may not be necessarily provided (see FIG. 3). The liquid container 21 can be disposed at a position that can impart negative pressure suitable for ejecting liquid toward the liquid ejecting head 22 (for example, in the range of approximately −0.1 kPa to −3 kPa).

According to the second embodiment, the advantageous effect similar to the first embodiment can be obtained even in the liquid ejecting apparatus 11 which does not include the pressure regulating valve 41.

Third Embodiment

Figure 4:
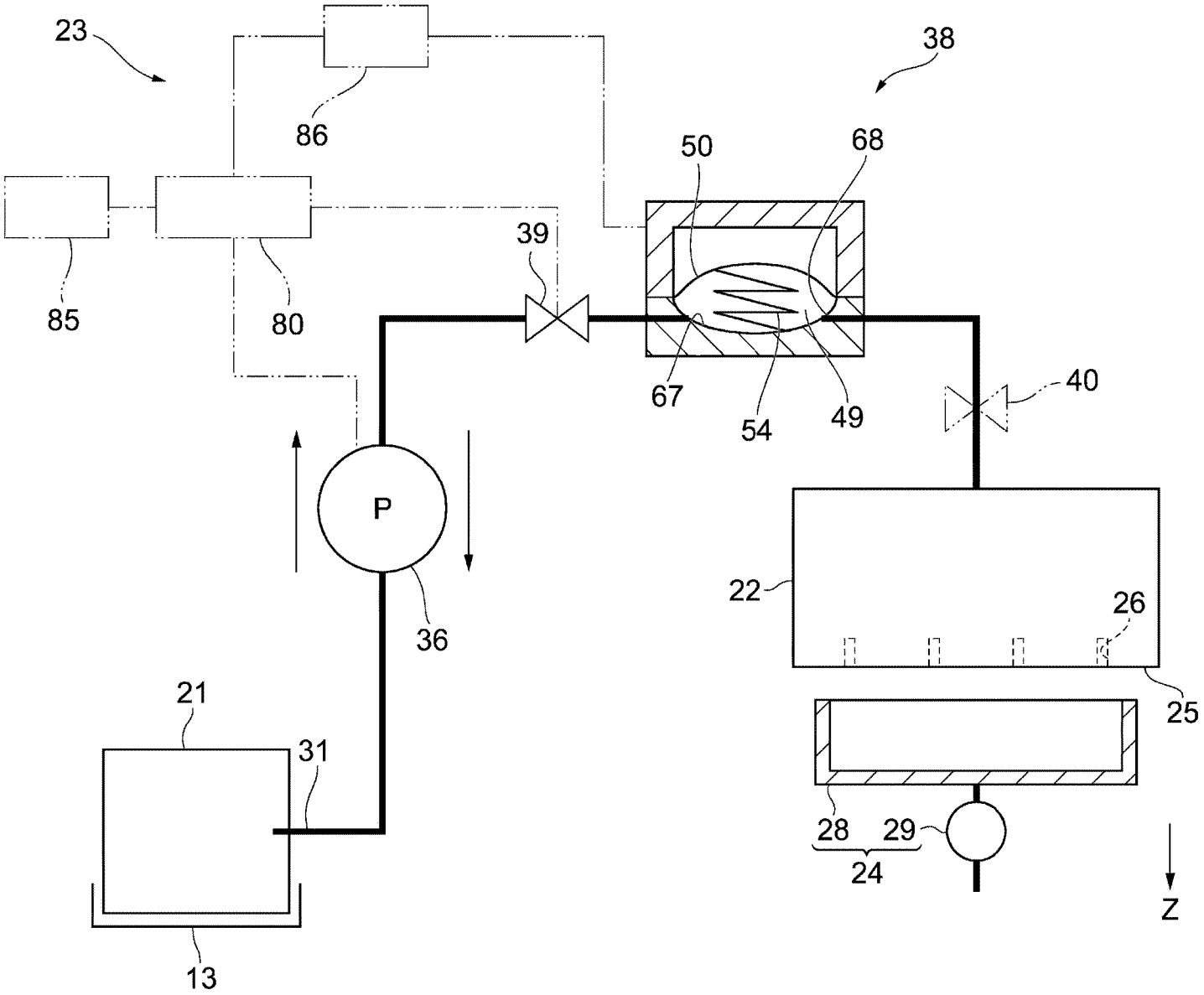
FIG. 4 is a schematic diagram of a supply portion, illustrating another embodiment of the liquid ejecting apparatus.

As shown in FIG. 4, the liquid ejecting apparatus 11 has the outlet 68 of the buffer chamber 38 provided at a position that does not face the flexible member 50, and may have insufficient function as a choke valve. Accordingly, in the present embodiment, in order to compensate this lack of function, the supply flow path 31 between the pump (liquid feeding unit) 36 and the storage chamber 49 is provided with a first open/close valve 39 that can open and close the supply flow path 31 by the control portion 80. Operations in choke cleaning in such a case will be described below by using examples. (1) While the first open/close valve 39 is open, reverse feeding of liquid is performed by using the pump 36. (2) The reverse feeding is stopped when liquid in the storage chamber 49 decreases by a predetermined amount, and the supply flow path 31 is closed by the first open/close valve 39. (3) Liquid is suctioned through the nozzles 26 by using the maintenance portion (suction unit) 24. (4) The first open/close valve 39 is opened, and forward feeding of liquid by driving of the pump 36 is started.

In the above (3), the timing of closing the first open/close valve 39 is preferably simultaneous with or before stopping of reverse feeding. Further, in the above (4), the timing of actuation of the pump 36 is preferably simultaneous with or before opening of the first open/close valve 39.

According to the third embodiment, the same advantageous effects as those of the first and second embodiments can be obtained even if the buffer chamber 38 has a configuration that fails to perform sufficient function as a choke valve.

The above embodiments may be modified as described in the following modified examples. Further, the configurations included in the above embodiments and the configurations included in the following modified examples may be combined in any way, or the configurations included in the following modified examples may be combined in any way. In the following description, the same reference characters are given to the components having the same functions as those of the previously described components to thereby avoid the duplicated description.

The introduction unit 67 for introducing liquid supplied from the liquid container 21 into the storage chamber 49 is preferably disposed at a position in the lower part of the storage chamber 49. With this configuration, air present in the storage chamber 49 can be prevented from flowing back toward the liquid container 21 during reverse feeding of liquid in the storage chamber 49. In the case where the flexible member 50 is configured to abut the introduction unit 67 due to a decrease of liquid in the storage chamber 49, the flexible member 50 is preferably configured to abut the outlet 68 before it abuts the introduction unit 67 in reverse feeding of liquid performed by the pump 36. With this configuration, choke cleaning can be performed without discharging and wasting liquid stored in the liquid chamber during choke cleaning.

A pressure measuring unit for measuring a pressure in the supply flow path 31 between the pump 36 and the storage chamber 49 may be provided instead of the detecting section 86 so that the pressure can be used to detect when the supply flow path 31 is closed or when the volume in the storage chamber 49 reaches the first volume or the second volume.

A second open/close valve 40 for closing the supply flow path 31 may be provided between the buffer chamber 38 and the liquid ejecting head 22 in the supply flow path 31. In reverse feeding of liquid from the storage chamber 49 toward the liquid container 21, liquid in the storage chamber 49 can be fed back to the liquid container 21 while preventing air from being entrained through the nozzles 26 by driving the pump 36 with the supply flow path 31 being closed by the second open/close valve 40.

In the first and second embodiments, choke cleaning using the second open/close valve 40 is preferably performed as follows. (1) The supply flow path 31 is closed by the second open/close valve 40. (2) The pump 36 is actuated to perform reverse feeding of liquid from the storage chamber 49 toward the liquid container 21. (3) The suction mechanism 29 is driven to perform suctioning. (4) After the volume of the storage chamber 49 becomes smaller than the first volume, driving of the pump 36 is stopped. (5) Closure of the supply flow path 31 by the second open/close valve 40 is released. (6) The pump 36 is again driven to supply liquid from the liquid container 21 into the storage chamber 49.

In the above (3), the timing of actuation of the suction mechanism 29 may be simultaneous with, before, or after starting of reverse feeding in the above (2). Further, in the above (5), the timing of releasing closure of the supply flow path 31 by the second open/close valve 40 may be simultaneous with, before, or after driving of the pump 36 in the above (4) as long as the volume of the storage chamber 49 is smaller than the volume of the first volume.

In the third embodiment, choke cleaning using the second open/close valve 40 is preferably performed as follows. (1) The supply flow path 31 is closed by the second open/close valve 40. (2) The pump 36 is actuated to perform reverse feeding of liquid from the storage chamber 49 toward the liquid container 21. (3) The suction mechanism 29 is driven to perform suctioning. (4) After the volume of the storage chamber 49 becomes smaller than the first volume, the supply flow path 31 is closed by the first open/close valve 39. (5) Closure of the supply flow path 31 by the second open/close valve 40 is released. (6) Driving of the pump 36 is stopped. (7) The pump 36 is again driven to supply liquid from the liquid container 21. (8) Closure of the supply flow path by the first open/close valve 39 is released.

In the above (3), the timing of actuation of the suction mechanism 29 may be simultaneous with, before, or after starting of reverse feeding in the above (2). Further, the timings of performing the above (5) and (6) may be simultaneous, or either one of (5) or (6) may be performed before the other. However, the timings are preferably simultaneous with or after closure of the supply flow path 31 by the first open/close valve 39 in the above (4). In the above (8), the timing of releasing closure of the supply flow path by the first open/close valve 39 is preferably simultaneous with or after actuation of the pump 36 in the above (7).

The liquid ejecting apparatus 11 may be a line recording type that performs recording by a line type liquid ejecting head 22 which is elongated in the medium width direction, a serial recording type that performs recording by the liquid ejecting head 22 moving in the medium width direction, or a lateral recording type that performs recording by the liquid ejecting head 22 moving in two directions of the medium transport direction and the width direction.

The medium is not limited to a paper sheet, and may also be a sheet or film made of synthetic resin, or a fabric. For example, the medium may be a plastic film or a thin plate, or a cloth for use with a fabric printing apparatus.

Further, liquid may be any substance in a liquid phase, and includes liquid materials with high or low viscosity, sol, gel water, other inorganic solvent, organic solvent, solution, liquid resin, and liquid metal (metallic melt). In addition, liquid includes not only one form of substances, but also those in which particles of functional materials made of solid substances such as pigments or metal particles are dissolved, dispersed, or mixed in a solvent. Typical examples of liquid include ink. Ink should be construed as encompassing various types of liquid compositions such as general water based ink, oil based ink, gel ink, and hot-melt ink. Technical ideas and their advantageous effects according to the aforementioned embodiments will now be described.

Idea 1

A liquid ejecting apparatus including: a liquid ejecting head that ejects liquid through a nozzle; a supply flow path that supplies the liquid from a liquid container containing the liquid to the liquid ejecting head; a liquid chamber provided in a buffer chamber disposed in the supply flow path, the liquid chamber being configured to change in volume in response to displacement of a flexible member; a liquid feeding unit of a reversible type disposed in the supply flow path between the liquid container and the liquid chamber; a control portion that controls driving of the liquid feeding unit to perform forward feeding of the liquid from the liquid container to the liquid chamber and reverse feeding of the liquid from the liquid chamber to the liquid container; and a suction unit that suctions liquid through the nozzle, wherein the flexible member causes a flow rate of the liquid flowing in the supply flow path to decrease by being displaced in a direction to reduce a volume of the liquid chamber due to a decrease of the liquid in the liquid chamber, and the control portion controls the liquid feeding unit to perform reverse feeding of the liquid from the liquid chamber to the liquid container before the suction unit suctions the liquid through the nozzle.

With this configuration, the buffer chamber can also serve as a choke valve, and choke cleaning can be performed without discharging and wasting liquid stored in the liquid chamber during choke cleaning.

Idea 2

The liquid ejecting apparatus according to Idea 1, wherein the control portion controls the liquid feeding unit to perform reverse feeding of the liquid from the liquid chamber to the liquid container until a volume of the liquid chamber becomes smaller than a first volume before the suction unit suctions the liquid through the nozzle.

With this configuration, choke cleaning can be performed without discharging and wasting liquid stored in the liquid chamber of the buffer chamber during choke cleaning.

Idea 3

The liquid ejecting apparatus according to Idea 1 or 2, wherein the control portion controls the liquid feeding unit to perform forward feeding of the liquid from the liquid container to the liquid chamber after the suction unit suctions the liquid through the nozzle.

With this configuration, liquid which has been supplied to the buffer chamber can be ejected toward the liquid ejecting head.

Idea 4

The liquid ejecting apparatus according to Idea 2 or 3, wherein the control portion controls the liquid feeding unit to perform forward feeding of the liquid from the liquid container to the liquid chamber until a volume of the liquid chamber becomes larger than a second volume after the suction unit suctions the liquid through the nozzle.

With this configuration, a sufficient amount of liquid can be supplied to the liquid chamber.

Idea 5

The liquid ejecting apparatus according to any one of Ideas 1 to 4, wherein the control portion performs forward feeding of the liquid from the liquid container to the liquid chamber until a volume of the liquid chamber becomes larger than the second volume before performing reverse feeding of the liquid from the liquid chamber to the liquid container.

With this configuration, it is possible to confirm in advance whether the amount of remaining liquid in the liquid container is sufficient for performing choke cleaning.

Idea 6

The liquid ejecting apparatus according to Idea 5, wherein, when a volume of the liquid chamber does not reach the second volume due to forward feeding of the liquid from the liquid container to the liquid chamber, notification is made and the control portion stops the liquid feeding unit.

With this configuration, notification can be made when the amount of remaining liquid is not sufficient for performing choke cleaning, and the operation can be automatically stopped.

Idea 7

The liquid ejecting apparatus according to Idea 6, wherein, when the volume of the liquid chamber does not reach the second volume and the control portion stops the liquid feeding unit, the control portion causes the suction unit to perform suctioning of a predetermined amount from the state.

With this configuration, when the amount of remaining liquid is not sufficient for performing choke cleaning, the operation can be automatically changed to suction cleaning, which involves a smaller suctioning amount than choke cleaning.

Idea 8

The liquid ejecting apparatus according to Idea 6, wherein, when the volume of the liquid chamber does not reach the second volume and the control portion stops the liquid feeding unit, the control unit prompts selection of at least one of performing suction by the suction unit from the state and replacing the liquid container.

With this configuration, a user can choose the subsequent operation when the amount of remaining liquid is not sufficient for performing choke cleaning.

Idea 9

The liquid ejecting apparatus according to any one of Ideas 1 to 8, further including a detecting section that detects a volume of the liquid chamber.

With this configuration, a volume of the liquid chamber can be readily determined.

Idea 10

The liquid ejecting apparatus according to any one of Ideas 1 to 9, further including a pressure regulating valve disposed in the supply flow path on a downstream side of the liquid chamber, the pressure regulating valve being configured to open when a downstream side of the pressure regulating valve reaches a predetermined negative pressure.

With this configuration, the liquid ejecting head can be prevented from being effected by pressure change on the upstream side due to liquid migration.

Idea 11

The liquid ejecting apparatus according to any one of Ideas 1 to 10, wherein the buffer chamber includes a flexible member that forms part of the liquid chamber, and the flexible member is displaced in a direction to decrease a volume of the liquid chamber with a decrease in the liquid of the liquid chamber to thereby reduce a flow rate of the liquid flowing in the supply flow path.

With this configuration, the flexible member in the buffer chamber can also serve as a choke valve, and choke cleaning can be performed without discharging and wasting liquid stored in the liquid chamber during choke cleaning.

Idea 12

The liquid ejecting apparatus according to Idea 11, further including a first urging portion that urges the flexible member in a direction to reduce a volume of the liquid chamber.

With this configuration, liquid can be pressurized and supplied to the liquid ejecting head.

Idea 13

The liquid ejecting apparatus according to Idea 11, further including a second urging portion that urges the flexible member in a direction to increase a volume of the liquid chamber, and the nozzle of the liquid ejecting head is disposed vertically above a top of the liquid container.

With this configuration, a negative pressure suitable for ejecting liquid toward the liquid ejecting head can be imparted.

The entire disclosure of Japanese Patent Application No. 2018-047624, filed Mar. 15, 2018 is expressly incorporated by reference herein.

What is claimed is:

1. A liquid ejecting apparatus comprising:

a liquid ejecting head that ejects liquid through a nozzle;

a supply flow path that supplies the liquid from a liquid container containing the liquid to the liquid ejecting head;

a liquid chamber provided in a buffer chamber disposed in the supply flow path, the liquid chamber being configured to change in volume;

a liquid feeding unit of a reversible type disposed in the supply flow path between the liquid container and the liquid chamber;

a control portion that controls driving of the liquid feeding unit to perform forward feeding of the liquid from the liquid container to the liquid chamber and reverse feeding of the liquid from the liquid chamber to the liquid container; and a suction unit that suctions liquid through the nozzle, wherein the buffer chamber causes a flow rate of the liquid flowing in the supply flow path to decrease with a decrease of the liquid in the liquid chamber, and the control portion controls the liquid feeding unit to perform reverse feeding of the liquid from the liquid chamber to the liquid container before the suction unit suctions the liquid through the nozzle.

2. The liquid ejecting apparatus according to claim 1, wherein the control portion controls the liquid feeding unit to perform reverse feeding of the liquid from the liquid chamber to the liquid container until a volume of the liquid chamber becomes smaller than a first volume before the suction unit suctions the liquid through the nozzle.

3. The liquid ejecting apparatus according to claim 1, wherein the control portion controls the liquid feeding unit to perform forward feeding of the liquid from the liquid container to the liquid chamber after the suction unit suctions the liquid through the nozzle.

4. The liquid ejecting apparatus according to claim 3, wherein the control portion controls the liquid feeding unit to perform forward feeding of the liquid from the liquid container to the liquid chamber until a volume of the liquid chamber becomes larger than a second volume after the suction unit suctions the liquid through the nozzle.

5. The liquid ejecting apparatus according to claim 1, wherein the control portion performs forward feeding of the liquid from the liquid container to the liquid chamber until a volume of the liquid chamber becomes larger than the second volume before performing reverse feeding of the liquid from the liquid chamber to the liquid container.

6. The liquid ejecting apparatus according to claim 5, wherein, When a volume of the liquid chamber does not reach the second volume due to forward feeding of the liquid from the liquid container to the liquid chamber, notification is made and the control portion stops the liquid feeding unit.

7. The liquid ejecting apparatus according to claim 6, wherein, when the volume of the liquid chamber does not reach the second volume and the control portion stops the liquid feeding unit, the control portion causes the suction unit to perform suctioning of a predetermined amount.

8. The liquid ejecting apparatus according to claim 6, wherein, when the volume of the liquid chamber does not reach the second volume and the control portion stops the liquid feeding unit, the control unit prompts selection of at least one of performing suction by the suction unit and replacing the liquid container.

9. The liquid ejecting apparatus according to claim 1, further comprising a detecting section that detects a volume of the liquid chamber.

10. The liquid ejecting apparatus according to claim 1, further comprising a pressure regulating valve disposed in the supply flow path on a downstream side of the liquid chamber, the pressure regulating valve being configured to open when a downstream side of the pressure regulating valve reaches a predetermined negative pressure.

11. The liquid ejecting apparatus according to claim 1, wherein the buffer chamber includes a flexible member that forms part of the liquid chamber, and the flexible member is displaced in a direction to reduce a volume of the liquid chamber with a decrease in the liquid of the liquid chamber to thereby reduce a flow rate of the liquid flowing in the supply flow path.

12. The liquid ejecting apparatus according to claim 11, further comprising a first urging portion that urges the flexible member in a direction to reduce a volume of the liquid chamber.

13. The liquid ejecting apparatus according to claim 11, further comprising a second urging portion that urges the flexible member in a direction to increase a volume of the liquid chamber, and the nozzle of the liquid ejecting head is disposed vertically above a top of the liquid container.

* * * * *